United States Patent [19]

Larson

[11] Patent Number: 4,947,823

[45] Date of Patent: Aug. 14, 1990

[54] ARROW REST FOR ARCHERY BOWS

[75] Inventor: Marlow W. Larson, Ogden, Utah

[73] Assignee: Browning, Morgan, Utah

[21] Appl. No.: 270,056

[22] Filed: Nov. 14, 1988

[51] Int. Cl.[5] ..... F41B 5/00

[52] U.S. Cl. ..... 124/41.1; 124/24.1

[58] Field of Search ..... 124/41 A, 23 R, 26, 124/88, DIG. 1, 24 R, 41 R

[56] References Cited

U.S. PATENT DOCUMENTS 3,871,352 3/1975 Stanislawski et al. ..... 124/24 R 4,548,189 10/1985 Pietraszek et al. ..... 124/41 A 4,796,597 1/1989 Farro ..... 124/41 A

OTHER PUBLICATIONS

"Nu Match", arrow rest advertisement, Bow and Arrow Magazine, Dec. 1986, p. 23.

*Primary Examiner*—Randolph A. Reese

*Assistant Examiner*—Jeffrey L. Thompson

*Attorney, Agent, or Firm*—Trask, Britt & Rossa

[57] ABSTRACT

An arrow rest includes a holder for an arrow shaft connected to a base support by a resilient post flexible in all directions normal its longitudinal axis.

4 Claims, 2 Drawing Sheets

ARROW REST FOR ARCHERY BOWS

BACKGROUND OF THE INVENTION

1. Field

This invention relates to archery and is directed to arrow rests mounted in association with the handle riser of an archery bow. It is particularly directed to an improved such arrow rest which provides flexibility in all directions parallel the horizontal plane of the arrow prior to launch.

22. State of the Art

There has evolved a multiplicity of arrow rest structures, each of which has certain advantages. An arrow rest structure typically comprises an assembly adapted for mounting in association with a handle riser of an archery bow. It may be mounted directly to the riser, but versions are available for mounting to other structures which are then mounted to the handle riser. Typical of such other structures is the overdraw assembly which is widely used with modern archery bows. In any event, the assembly includes a holder, sometimes called a launcher, upon which the shaft of the arrow rests prior to launching of the arrow by an archer. This holder is connected to a support system, such as a base support attached to the handle riser, by means of connecting structure which maintains the holder in physical association with the base support.

The principal purpose of an arrow rest is to provide a stable support for the shaft of an arrow prior to and during launching of the arrow while avoiding interference between the arrow, particularly its fletching, and the structural members of the bow. The components of the arrow rest itself can cause interference with the fletching of an arrow as it passes the arrow rest. Accordingly, much of the attention in design of such arrow rests has been devoted to expedients which avoid or minimize contact by the fletching of the arrow as it passes the holder. In all currently available designs there remains some possibility for interference during launching. Such interference impacts negatively on the ability of an archer reliably to reproduce performance over a plurality of shots. That is, while the fletching of certain arrows may successfully avoid contact of the holder during several of a series of shots, other arrows may nevertheless be obstructed or dislodged from their intended course during the series as a consequence of such contact.

Current designs of arrow rests lack sufficient flexibility in the directions parallel the horizontal plane of the arrow prior to launching or during launching to adjust to varying circumstances confronted during a plurality of launches. Typical arrow rest structures are disclosed in U.S. Pat. Nos. 3,865,096; 3,935,854; 4,299,195; 4,332,232; 4,398,528; 4,476,846; 4,489,704; 4,492,214; 4,664,093; 4,676,220; and 4,686,956. None of the arrow rests disclosed by any of the aforementioned patents provide for adequate flexible motion under gentle pressure in all of the directions parallel the horizontal plane of the arrow during launching. Accordingly, it is possible with each of these, devices to cause interference with the flight of the arrow under circumstances which deviate only slightly from the design considerations of the device.

Conventional practice, and the practice followed in this disclosure, is to consider an archery bow to be oriented in an approximately vertical orientation so that an arrow nocked for shooting is held in an approximately horizontal position having a longitudinal axis which is included within an approximately horizontal plane. It is recognized that on occasion an archer will in fact shoot from an elevated location with respect to his target. In some instances, an archer may shoot uphill. In either case, the bow may in fact not be vertical with respect to the surface of the earth, but it is in any event considered to be in its vertically held position. Accordingly, reference herein to horizontal planes, horizontal axes, vertical planes and vertical axes should be understood as being with reference to a vertical plane containing the bow held in its normal vertical shooting position.

The archery bow arrow rest of the present invention may be embodied in a number of configurations, both with respect to the launcher or holder for the arrow shaft and with respect to the base support mechanism utilized for attachment of the arrow rest assembly in association with the riser handle of an archery bow. In any event, the connection mechanism, (the structure which connects the holder with the base support) is fashioned as a resilient post element with a substantially stable "at-rest" position wherein the longitudinal axis of the post element intersects the horizontal plane containing the longitudinal axis of an arrow when it is nocked with its shaft resting upon the launcher. That is, the post is generally upstanding, although not necessarily vertical to the base support. It is important that the resilient post element be sufficiently flexible in all horizontal directions (that is, in all directions parallel to the horizontal plane which includes the axis of the arrow shaft). The portion of the post proximate the arrow shaft must be urgible along any of those directions through the gentle force exerted by the arrow shaft during launching. This feature is particularly important as it applies to contact of the holder by the fletching of an arrow. While the post element easily withstands the compression forces exerted by the arrow shaft resting on the holder, it has little resistance to movement or flexure in any direction normal its longitudinal axis.

Although the resilient post element may be fashioned in various ways, e.g., as a coil spring or resilient elastic tube, it is presently preferred that this element consist of a single strand of flexible wire. This strand may be coupled to the base support by means of coils effecting a coil-spring linkage. It may also be attached to the holder or launcher element by means of coils to effect a coil spring linkage at each of its ends. Such linkages are preferred to avoid breakage resulting from repeated flexures.

BRIEF DESCRIPTION OF THE DRAWINGS

In the drawings, which illustrate what is presently regarded as the best mode for carrying out the invention.

DESCRIPTION OF THE ILLUSTRATED EMBODIMENTS

Figure 1:
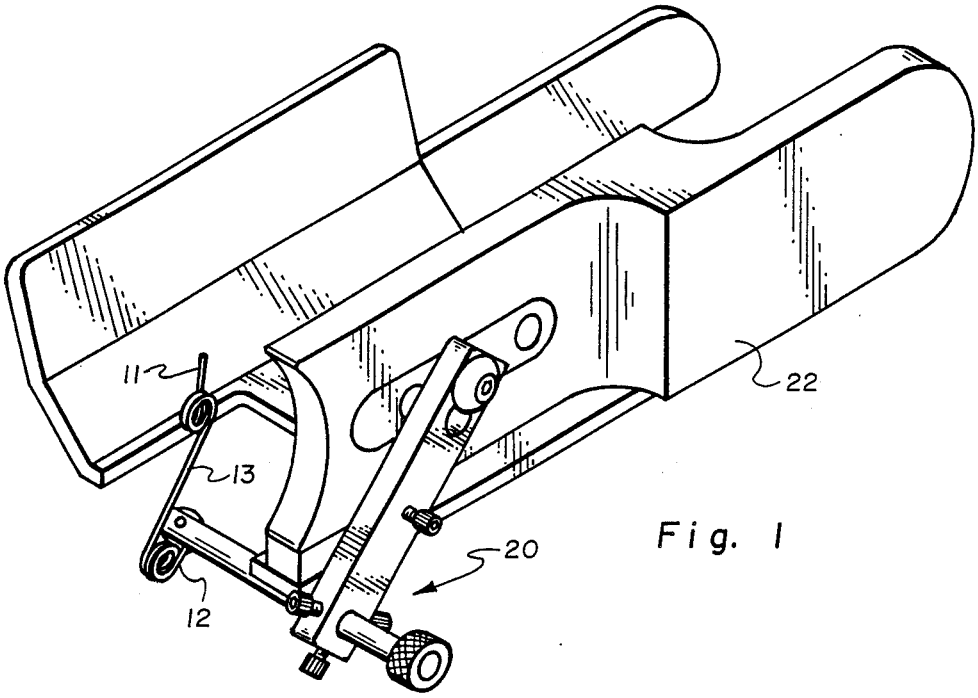
FIG. 1 illustrates an arrow rest assembly of this invention mounted to an overdraw assembly.
Figure 3:
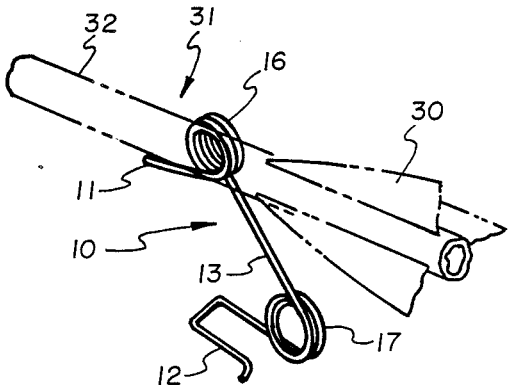
FIG. 3 illustrates the arrow rest of FIGS. 1 and 2 separated from the remainder of the assembly and illustrated with an arrow shaft shown in phantom positioned prior to or during a launch.
Figure 2:
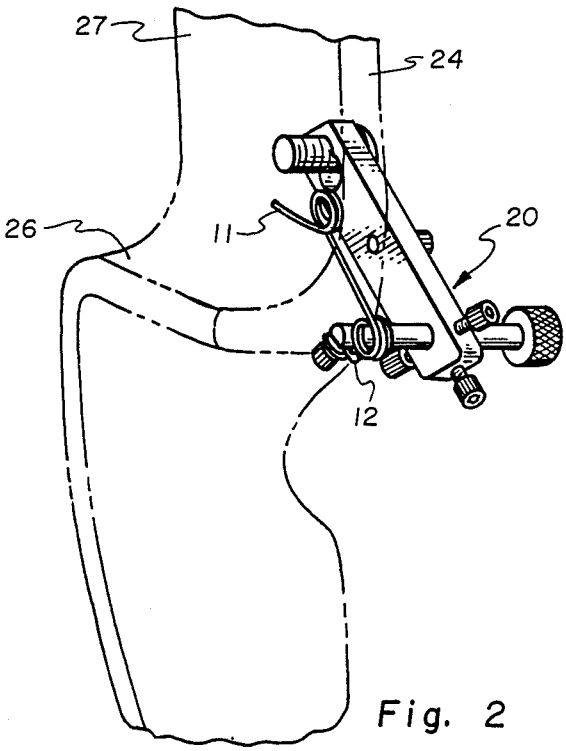
FIG. 2 illustrates the arrow rest assembly of FIG. 1 mounted directly to a handle riser, a segment of the handle riser being shown in phantom.

FIGS. 1 through 3 illustrate a typical arrow rest 10 with a holder 11, base support 12, and resilient post element 13. The entire arrow rest 10 is formed from a single piece or strand of resilient, flexible wire and is configurated such that the holder 11 merges with the post element 13 through a first coil spring 16, and the post element 13 in turn merges through a second coil spring 17 with the base support 12.

FIGS. 1 and 2 show alternative arrangements by which the base support 12 is attached to structure designated generally 20 to form an arrow rest assembly. The assembly is illustrated in FIG. 1 connected to an overdraw assembly 22, and FIG. 2 illustrates the assembly 20 connected directly to the riser handle 24 of an archery bow. Of course, the overdraw assembly 22 is intended for attachment to a riser assembly such as illustrated in FIG. 2 to hold the launcher 11 in approximately the same horizontal plane occupied by the holder 11 as illustrated in FIG. 2.

The riser handle includes an arrow shelf 26 and a side wall 27, which together define a sighting window. The arrow rests of this invention are positioned within or behind the sighting window exactly as arrow rests currently in use are positioned. In contrast to such arrow rests, however, the flexible post element 13 permits the holder 11 to be easily urged in any of the directions transverse the longitudinal axis of the post element 13. Accordingly, the fletching 30 of the arrow designated generally 31 and shown in phantom in FIG. 3 will easily urge the holder 11, spring 16 and post 13 aside as it travels during and following its launch. In effect, the holder 11 and spring 16, which may together be considered as comprising a launcher, are free to move down toward the base 12 or laterally to either side depending upon the forces applied by the arrow shaft 32 and fletching 30 during travel of the arrow 31.

Figure 4:
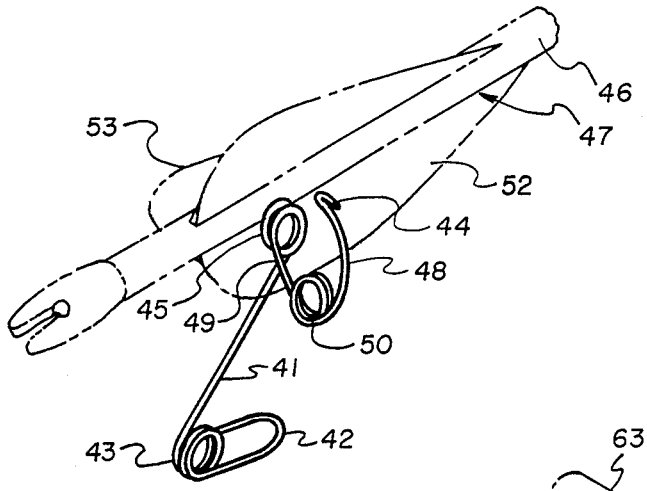
FIG. 4 illustrates an alternative form of the arrow rest of this invention showing in phantom the fletching and nock of an arrow following separation from the bow string during launch.

In the alternative embodiment illustrated by FIG. 4, the flexible post 41 is formed of a single strand of wire as is the case of the corresponding element 13 in the embodiment illustrated by FIGS. 1 through 3. The base support 42 is similar to the corresponding structure 12 of the embodiment of FIG. 3 and is connected to the post 41 in a similar fashion through a coil spring 43. A launcher is formed by the end 44 and the coil 45, which together define a portion of a holder for the shaft 46 of the arrow designated generally 47. Other components of the holder include a first segment 48 and a second segment 49 connected by a coil spring 50. As illustrated by FIG. 4, when the arrow 47 is launched, the feather 52 of the fletching, designated generally 53, passes between the segments 48 and 49 urging the tip 44 away from the spring 45 to the degree necessary. Concurrently, the post element 41 is urged down and in any transverse direction which is responsive to forces applied to it or the elements 44, 45, 48 or 49 of the arrow holder by the arrow 47 as it travels following its launch.

Figure 5:
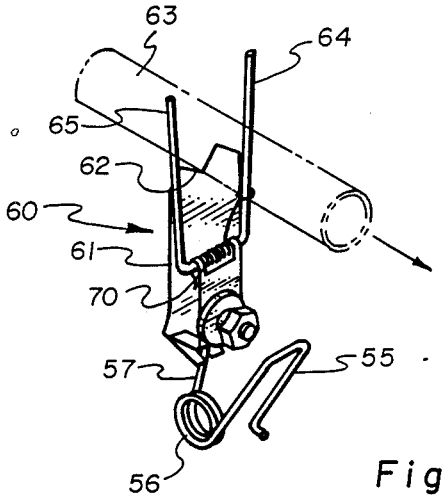
FIGS. 5 and 6 illustrate an alternative highly preferred embodiment of the arrow rest of this invention both prior to and during launch with portions of an arrow shown in phantom.
Figure 6:
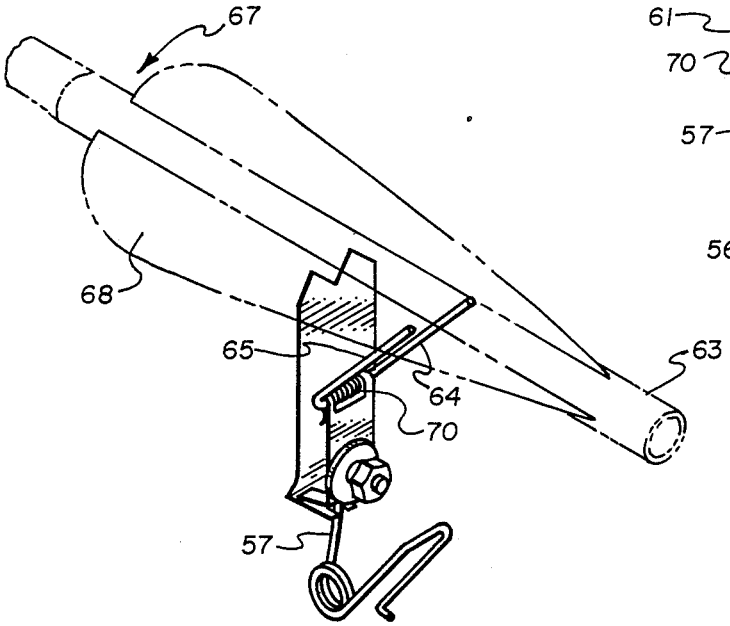

Referring to FIG. 5, an alternative embodiment is constructed with a base support 55 connected through a spring 56 to a flexible resilient post element 57. The base 55, spring 56 and post 57 are constructed of a single piece of wire as in the case of the previously described embodiments. A launcher designated generally 60 is carried at the distal end of the upstanding flexible post element 57. The launcher 60 includes a holder 61 fashioned of a flat strip of rigid material such as metal or plastic and provided with a notch 62 at its upper end. The notch accommodates the shaft 63 of an arrow as illustrated as an assist in retaining the shaft 63 and the notch 62 to spring-biased upstanding wire legs 64, 65. FIG. 5 illustrates the positioning of the legs 64, 65 prior to launching of the arrow designated generally 67 (FIG. 6). FIG. 6 illustrates the legs 64, 65 tilted forward as the fletching 68 of the arrow 67 travels past the launcher 62 following its launch. The legs 64 and 65 are lightly biased towards the vertical position illustrated in FIG. 5 by means of a weak coil spring 70. As in the case of the previously described embodiments, the resilient flexible post element 57 is free to move in any position normal its longitudinal axis in response to forces applied by the traveling arrow 67.

Figure 7:
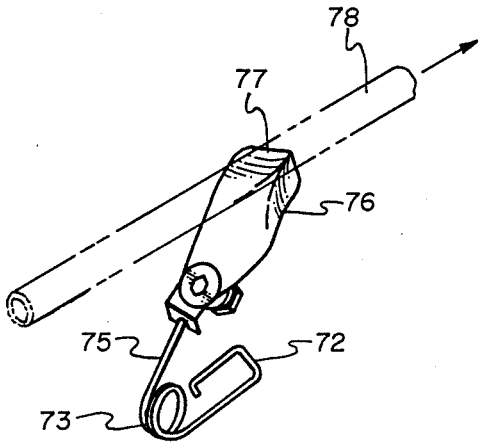
FIG. 7 shows an alternative preferred embodiment of the arrow rest of this invention with a portion of the shaft of an arrow shown in phantom.

FIG. 7 illustrates yet another embodiment with a base support 72 connected by means of a coil spring 73 to a flexible resilient post element 75 which carries at its distal end a holder 76 which presents a slightly dished upper surface 77 to lightly restrain the shaft 78 of an arrow. The function and operation of the embodiment illustrated by FIG. 7 is similar to that described in connection with the previously described embodiments.

By "resilient," as used in this disclosure, is meant the property of a material, specifically that of the disclosed post elements, to return to its original position once displaced from that position. By "flexible" is meant the property of a material whereby an element made from that material may be readily deflected from its original position The preferred material of construction contemplated by the present invention for the flexible resilient post member is a flexible resilient wire. The length of such a wire may be as short as a fraction of an inch or as long as several inches. The wire should have sufficient strength to support the load of an arrow shaft without buckling or bending, but nevertheless should possess sufficient resiliency and flexibility to be easily displaced in any lateral position, yet return to an original position when released. It is within contemplation that various plastic or elastomeric rods or tubing may be used in place of metal wire.

Reference herein to the details of the illustrated embodiments is not intended to restrict the scope of the appended claims which themselves recite those features regarded as important to the invention.

What is claimed is:

1. In an arrow rest adapted for mounting in association with the handle riser of an archery bow to support the shaft of an arrow with the longitudinal axis of the arrow transverse the sighting window of said riser, said assembly including a holder for an arrow shaft, a base support for attachment to structure associated with said handle riser, and connection means for maintaining said holder in physical association with said base support, the improvement comprising:

said connection means being fashioned as a resilient post element with a substantially stable at-rest position, wherein the longitudinal axis of said post element intersects the horizontal plane containing said longitudinal axis of said arrow shaft, said post element being flexible in all directions normal its and longitudinal axis;

said post being spatially arranged with respect to said base support to permit the unimpeded movement of said post in all said directions in response to launching of an arrow from said holder.

2. An improvement according to claim 1 wherein said connection means, holder and base support are formed of a single strand off resilient flexible wire.

3. An improvement according to claim 1 further including a holder comprising:

an upstanding element with a notch adapted to receive the shaft of an arrow; and a pair of normally upstanding arms located to straddle the shaft of an arrow placed atop said notch, said arms being pivotably mounted and spring biased to resistably permit movement of said arms from a normally vertical orientation towards a horizontal orientation.

4. An improvement according to claim 1 further including a holder comprising:

a platform element carried by the end of said post element which an upper surface carrying a groove adapted to receive the shaft of an arrow.

* * * * *

UNITED STATES PATENT OFFICE

CERTIFICATE OF CORRECTION

Patent No. 4,947,823 Dated AUGUST 14, 1990

Inventor(s) MARLOW W. LARSON

It is certified that error appears in the above-identified patent and that said Letters Patent is hereby corrected as shown below:

In claim 1, column 5, line 3, delete "and" and insert --said--.

In claim 4, column 6, line 12, delete "which" and insert --with--.

Signed and Sealed this

Twelfth Day of November, 1991

*Attest:*

HARRY F. MANBECK, JR.

*Attesting Officer*

*Commissioner of Patents and Trademarks*